US009372020B2

(12) United States Patent
Cowans et al.

(10) Patent No.: US 9,372,020 B2
(45) Date of Patent: Jun. 21, 2016

(54) METHOD AND APPARATUS FOR THERMAL EXCHANGE WITH TWO-PHASE MEDIA

(71) Applicant: BE Aerospace, Inc., Wellington, FL (US)

(72) Inventors: Kenneth W. Cowans, Fullerton, CA (US); William W. Cowans, Fullerton, CA (US); Glenn Zubillaga, Canyon Lake, CA (US)

(73) Assignee: B/E AEROSPACE, INC., Wellington, FL (US)

( * ) Notice: Subject to any disclaimer, the term of this patent is extended or adjusted under 35 U.S.C. 154(b) by 55 days.

(21) Appl. No.: 13/975,211

(22) Filed: Aug. 23, 2013

(65) Prior Publication Data

US 2015/0040586 A1 Feb. 12, 2015

Related U.S. Application Data

(62) Division of application No. 12/558,641, filed on Sep. 14, 2009, now Pat. No. 8,532,832.

(60) Provisional application No. 61/192,881, filed on Sep. 23, 2008, provisional application No. 61/179,745, filed on May 20, 2009.

(51) Int. Cl.

| | |
|---|---|
| ***G05D 11/16*** | (2006.01) |
| ***F25B 41/04*** | (2006.01) |
| ***F25B 41/00*** | (2006.01) |
| ***F25B 49/00*** | (2006.01) |

(52) U.S. Cl.

CPC ..... *F25B 49/00* (2013.01); *F25B 41/00* (2013.01); *F25B 2400/01* (2013.01); *F25B 2600/2501* (2013.01)

(58) Field of Classification Search

USPC ..... 700/285, 299; 62/222, 498, 513

See application file for complete search history.

(56) References Cited

U.S. PATENT DOCUMENTS

| | | | | |
|---|---|---|---|---|
| 5,396,779 | A * | 3/1995 | Voss | 62/196.2 |
| 5,934,083 | A * | 8/1999 | Scherer et al. | 62/79 |
| 6,077,158 | A | 6/2000 | Lake et al. | |
| 6,102,113 | A * | 8/2000 | Cowans | 165/206 |
| 6,427,463 | B1 * | 8/2002 | James | 62/186 |
| 6,460,358 | B1 | 10/2002 | Hebert | |

(Continued)

FOREIGN PATENT DOCUMENTS

JP 3117866 B2 12/2000

*Primary Examiner* — Carlos Ortiz Rodriguez
*Assistant Examiner* — Olvin Lopez Alvarez
(74) *Attorney, Agent, or Firm* — Fulwider Patton LLP

(57) ABSTRACT

In a temperature control system using a controlled mix of high temperature pressurized gas and a cooled vapor/liquid flow of the same medium to cool a thermal load to a target temperature in a high energy environment, particular advantages are obtained in precision and efficiency by passing at least a substantial percentage of the cooled vapor/liquid flow through the thermal load directly, and thereafter mixing the output with a portion of the pressurized gas flow. This "post load mixing" approach increases the thermal transfer coefficient, improves control and facilities target temperature change. Ad added mixing between the cooled expanded flow and a lesser flow of pressurized gas also is used prior to the input to the thermal load. A further feature, termed a remote "Line Box", enables transport of the separate flows of the two phase medium through a substantial spacing from pressurizing and condensing units without undesired liquefaction in the transport lines.

3 Claims, 6 Drawing Sheets

(56) References Cited

U.S. PATENT DOCUMENTS

| | | | | |
|---|---|---|---|---|
| 6,775,996 | B2 | 8/2004 | Cowans | |
| 7,178,353 | B2 | 2/2007 | Cowans | |
| 7,337,625 | B1 | 3/2008 | Cowans | |
| 7,415,835 | B2 | 8/2008 | Cowans et al. | |
| 8,240,160 | B2 | 8/2012 | Cowans et al. | |
| 2003/0145610 | A1 | 8/2003 | Leuthner | |
| 2004/0231725 | A1* | 11/2004 | Hugger | 137/487.5 |
| 2005/0138958 | A1* | 6/2005 | Huang et al. | 62/498 |
| 2005/0183432 | A1 | 8/2005 | Cowans et al. | |
| 2007/0095097 | A1 | 5/2007 | Cowans et al. | |
| 2008/0022713 | A1* | 1/2008 | Jacobi | 62/434 |
| 2008/0092564 | A1* | 4/2008 | Sulc et al. | 62/90 |
| 2009/0056353 | A1* | 3/2009 | Sunderland | 62/214 |
| 2009/0105889 | A1 | 4/2009 | Cowans et al. | |
| 2009/0205345 | A1 | 8/2009 | Narayanamurthy et al. | |
| 2010/0138049 | A1 | 6/2010 | Creed et al. | |

* cited by examiner

| Parameters | | Conventional Chiller | Direct Chiller | Improvement Rate |
|---|---|---|---|---|
| Throughput | Ramp Up (sec) | 16 min, 9 sec | 4 min, 6 sec | 75% |
| | Ramp Down (sec) | 26 min, 4 sec | 5 min, 5 sec | 80% |
| | Response Time | 46 sec | 7 sec | 85% |
| Uniformity | Control Range | 3.7°C | 1.6°C | 57% |
| | On-Wafer Range | 20.39°C | 15.25°C | 25% |
| | | | | TOTAL AVG. 64.4% |

Fig. 6

METHOD AND APPARATUS FOR THERMAL EXCHANGE WITH TWO-PHASE MEDIA

REFERENCES TO PRIOR APPLICATIONS

This application is a divisional of application Ser. No. 12/558,641, filed Sep. 14, 2009, now U.S. Pat. No. 8,532,832 issued which relies for priority on similarly titled applications of the same inventors, namely a first provisional application filed Sep. 23, 2008, Ser. No. 61/192,881 and a second provisional application filed May 20, 2009, Ser. No. 61/179,745.

BACKGROUND OF THE INVENTION

With the growth of modern technology, improved temperature control systems have also been sought for maintaining a thermal load at a precise temperature under energy intensive conditions. Many such control systems also are required to change the temperature of the thermal load in accordance with process conditions, sometimes with great rapidity. As one illustration, semiconductor manufacturing equipment and processes are often dependent upon temperature control of the wafers or other elements on which various surfaces are being deposited or etched, using techniques which are highly energy intensive. It is thus often necessary to maintain a large semiconductor wafer which serves as the base for formation of thousands of minute complex integrated circuits, under precise temperature control, as the wafer is processed, as under plasma bombardment. By such processes, minute patterns may be selectively deposited or etched in the wafer surface.

Semiconductor manufacture is referenced here merely as one example of one process in which there is a need for precise temperature control under dynamic conditions. Other processes in which there are current or prospective demands for such capabilities will present themselves to those skilled in the art.

In the past, temperature stability in the item being processed has often been achieved by using particular fluids and geometries to define effective heat sinks, for withdrawing or supplying thermal energy from the operating zone as needed, to establish a desired effective temperature level in the item. It has been common, heretofore, to employ a thermal transfer medium which remains typically liquid throughout the entire temperature range used in a process. This medium can maintain adequate thermal transfer capability and at the same time avoid the complexity and unpredictability that would be introduced if a change of phase from liquid to vapor were to be introduced, wholly or partially.

Although the state of the art has been constantly evolving, few distinctly different methods were employed until a novel thermal control technique was introduced by Kenneth W. Cowans et al employing energy transfer using different phases of the same medium. Patents entitled "Thermal Control System and Method" (U.S. Pat. Nos. 7,178,353 and 7,415,835) have issued on this concept and are assigned to the assignee of the present application. This concept employs the thermodynamic properties of a refrigerant in both vapor and liquid phases, properly interrelated to exchange thermal energy with a load so as to maintain the temperature at a selected target level within a wide dynamic range. Consequently, the refrigerant can heat or cool a product and process, such as a semiconductor wafer of large size, at a single or a succession of different target temperatures. This concept has been referred to for convenience by the concise expression "Transfer Direct of Saturated Fluid", abbreviated TDSF. This descriptor recognizes and in a sense summarizes the operative sequence, in which a medium is first compressed to a high temperature gaseous state, then divided, under control, into two interdependent flows. One flow path maintains the fluid in high pressure gaseous phase, but in this flow path the flow rate and mass are varied in accordance with the target temperature to be maintained. Variation of the one flow affects the differential flow in the other path, in which the refrigerant is converted, by cooling, to liquid phase and the flow is then further cooled by expansion. In this path the flow rate is dependent on the heat load presented to the system. Typically, the flow in this liquefied path is regulated by a standard refrigeration thermo-expansion valve (TXV).

As disclosed in the referenced patents, the two flows, of high pressure gas and cooled expanded fluid/vapor, are recombined in a mixer before delivery to the thermal load. The target temperature for the load is established by adjusting the balance between the two flows by admitting a selected amount of hot gas flow, controlled such that needed pressure, temperature and enthalpy are maintained in a continuous loop.

The TDSF concept has numerous advantages. Some can be best expressed in terms of the range of temperatures that can be encompassed from hot (entirely pressurized gas) to maximum cooling (entirely expanded vapor). The concept also enables the load temperature to be maintained with precision. The target temperature can be adjusted bi-directionally and rapidly.

The use of a refrigerant having a temperature/pressure transition that is somewhere in mid-range relative to the operating temperature band, however, creates possibilities for undesired changes in refrigerant state under certain operating conditions. Situations have been encountered in which performance limitations have been imposed on TDSF systems because of installations which introduce substantial pressure drops or long transport lines for the refrigerant. These conditions can arise because, in a two-phase medium, pressure drops are also accompanied by temperature variations. For example, long line lengths from compressor and condenser units to a semiconductor processing site may be required for operative or geometrical considerations. Heretofore, installations which have inherently required the use of long transport distances for refrigerant media have sometimes imposed restraints on the use of the TDSF concept or the use of special expedients which add undesirable complexity and cost. It is also true that long lines can introduce another complication, that of 'puddling': If this occurs, the liquid phase can separate from the two-phase mixture creating variations in mass flow at the line's end. This can adversely alter control characteristics due to surging conditions as pure liquid and pure gaseous phases alternate with mixed two phase flow.

SUMMARY OF THE INVENTION

The present invention discloses a novel implementation of the TDSF concept of separating and later recombining a high pressure gas phase of a two-phase refrigerant medium with a cooled, liquefied and then expanded differential flow of the same medium, and application of the medium to the thermal load. In accordance with the invention the principal phase of the refrigerant that is propagated through the thermal load while the load is being heated is the cooled expanded differential flow. The combination of cooled expanded flow through the thermal load with the modulated high pressure gas flow occurs after as well as before the thermal load, so that this approach has been termed "Post Load Mixing" (PLM). The media fed into the thermal load heat exchanger is stabilized in temperature throughout its flow through that exchanger because it is responsive both to the enthalpy of the expanded component and the pressure modulated by the hot gas in the mixing process.

The PLM approach uses the two different phase states of the refrigerant in a uniquely integrated manner. The pressure of the suction line to the compressor is influenced by the mass of refrigerant received, since the compressor is a device that processes a fixed volume per unit of time. In the PLM system the flow through the thermal load has a smaller differential in temperature than would exist with unidirectional transport of fully mixed dual flows, and the thermal load temperature can be thus more tightly controlled. Essentially, the flow through the thermal load is so controlled as to be mainly or completely the cooled expanded component, and in consequence the pressure drop undergone by the refrigerant in passing through the load is lessened. Furthermore, by post load mixing after the refrigerant has passed through the load, the refrigerant passing through the thermal load has a greater percentage of liquid than if all the hot gas had been mixed before the load and thus has a higher heat transfer coefficient, so that thermal exchange is more efficient, particularly at and near the last portions of the heat exchanger passage.

The PLM concept employs some mixing of the two flows both before and after the thermal load, but in a selectable proportionality. This is done in a preferred embodiment by including two impedances in the paths supplying the high pressure hot gas to the mixing tees. Said impedances are settable as to magnitude. A flow of high pressure gas is branched off and combined with the cooled expanded flow at an input mixer coupled to the input to the thermal load. The flow bypassing the thermal load is also directed through a series-coupled solenoid valve which can be controlled so as to enable rapid changes of operating mode between post load mixing and fast heating of the thermal load. Said solenoid valve is closed when rapid heating of the thermal load is desired. This is usually employed when switching the load from one temperature to a hotter temperature, as when a chuck that is normally cold during processing is removed from the system to allow repair to be accomplished. Rapid heating will thus minimize the time needed for such repair and changeover.

The post load mixing approach may be used in certain geometries or applications requiring that the refrigerant be transported over a relatively large distance between the energizing (compressing and condensing) sites and the sites at which thermal exchange occurs. In accordance with the invention, substantial advantages are achieved in these situations by deploying the principal flow adjusting, combining and mixing circuits in a geometrically compact and thermodynamically adapted post load mixing unit, denoted the PLM line box (LB).

The PLM LB is for disposition in proximity to the thermal load and incorporates conduits for high pressure gas flow, liquefied refrigerant low, and return flow, as well as a thermo-expansion valve (TXV), an equalizer for the TXV, and check valves and mixing tees. The configuration, which forestalls mixing before the transport lines, is realized within a volume that is about one cubic foot or less. This unit may be described as comprising a remote control box.

In this combination, the thermo-expansion valve is proximately coupled to a temperature sensing bulb responsive to the temperature in the return line from the load after the mixing tee located downstream from the thermal load. Said thermo-expansion valve is also coupled with a pressure sensing line to the return line in a position proximate said temperature sensing bulb, which coupling serves to establish the external equalizer function. In those installations displaying a minimal pressure drop through the thermal load said thermo-expansion valve can be of the internally equalized type. When such non-equalizing valves are employed said coupling to the return line is not used. The two mixing tees are disposed separately, one before and one after the thermal load. The system may include a check valve before the first mixing tee, and, for flow regulation, a flow orifice is disposed before each mixing tee. A solenoid valve is located in series with the second mixing tee. Consequently, despite the fact that long transport lines may be needed between the phase conversion, energy demanding portions of the system and the thermal load at the process site, needed phase conversions and flow modulations are effected reliably without the danger of accumulation of internal liquids.

In accordance with other features of the invention, where transport lines and conditions present only marginal probability of liquefaction, the transport lines from the proportional valve and the thermo-expansion valve can be disposed to parallel but insulated externally from each other before being coupled to a mixer in the PLM configuration.

BRIEF DESCRIPTION OF THE DRAWINGS

A better understanding of the invention may be had by reference to the following description taken in conjunction with the accompanying drawings, in which:

FIG. 6 is a chart of tested performance characteristics of a system in accordance with the invention, in comparison to the performance of a conventional temperature control system, referred to as a "conventional chiller".

DETAILED DESCRIPTION OF THE INVENTION

Figure 1:
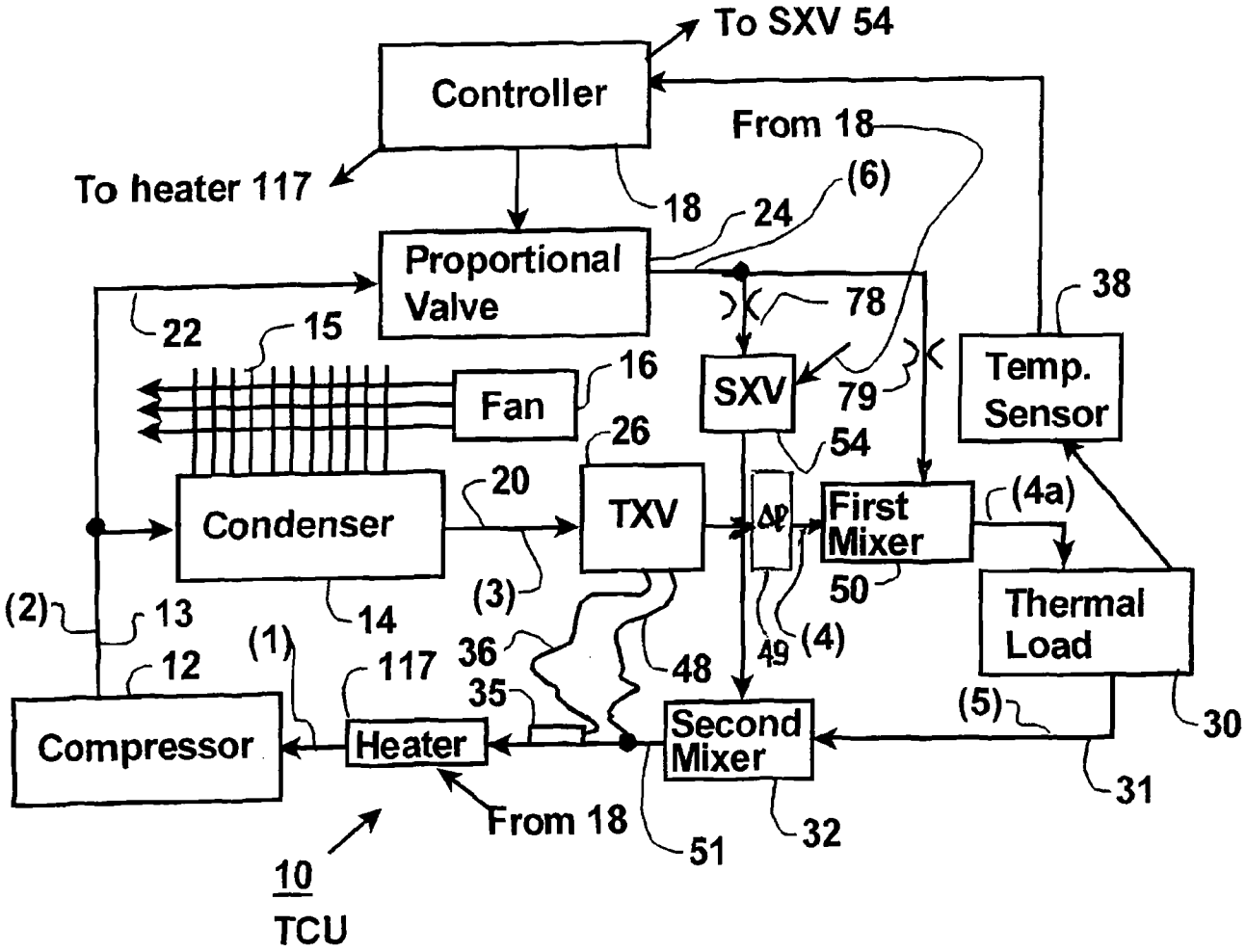
FIG. 1 is a block diagram of a system for thermal exchange using two-phase media in accordance with the PLM invention.

A generalized system utilizing post load mixing (PLM) is shown in FIG. 1, to which reference is now made. The thermal control system 10 or "TCU" is consistent with the TDSF concept but differentiated by incorporating the PLM approach, and forms a closed loop that encompasses an active thermal control system (TCU) 10 and a thermal load 30. The thermal load 30 is typically a heat exchanger that functions with a processing unit (not shown), such as a chuck for processing semiconductors. In the thermal control system 10 a refrigerant comprising a medium such as R-507 is input to a compressor 12 in gaseous form and a pressurized output is provided therefrom into a main line 13. One branch from the main line 13 includes an air cooled (in this example) condenser 14 having an external air-cooled fin structure 15 engaged by flow from a fan 16 shown only symbolically. The condenser 14 provides a fully or substantially liquefied output of refrigerant at an essentially ambient temperature in a first output path 20.

A separate branch from the compressor 12 output 13 is taken from a junction before the condenser 14 to direct pressurized hot gas from the compressor 12 into a second flow path 22. This second flow path 22 includes a proportional valve 24 that is operated by a controller 18 so as to adjust the proportion (in mass flow rate) or hot gas that is to be used out of the compressor 12 output. This adjustment modulates the two flows and ultimately determines the proportion of hot gas to be employed in the consequent mixture of the two flows, as described below. The adjustment consequently sets the target temperature for the thermal load 30.

In the first branch 20 the output from the condenser 14 is applied to a thermo-expansion valve TXV 26, this output being dependent on and determined by the differential temperature between the superheated gas as sensed a proximate by bulb 35 and the temperature of output fluid from the second mixer 32 a point in line 51 adjacent where the bulb 35 is located. The thermo-expansion valve 26 thus senses the pressure difference between liquid contained within bulb 35 and the pressure sensed by a line 48 connected to externally equalized TXV 26. The output flow from the TXV 26 is here coupled to the thermal load 30, which is depicted only generally. Said output flow from the TXV 26 travels through a delta P valve 49 which valve performs the same function as disclosed in U.S. Pat. No. 7,178,353. After passing through valve 49 the expanded cooled output from the TXV 26 mixes with some of the hot gas in the first mixing tee 50. The output 31 from the load 30 is, in accordance with the PLM approach, returned to the input of the compressor 12 via one input of a second mixing tee 32, which also receives, at a separate input, some of the output from the proportional valve 24. The output line from the second mixing tee 32 returns to the compressor 12, but the input pressure of this return flow is sensed on route to the compressor 12 input by the external equalization bulb 35 which is coupled into the TXV 26 via the line 36. This connection also provides the known external equalization feature disclosed in the patents referred to above and in other patents and applications on the TDSF system, so that it need not be described in further detail. In addition, the controller 18 for the proportional valve 24 receives a temperature input from a sensor 38 that is responsive to the temperature level at the thermal load 30. Alternatively, said temperature sensor 38 may be mounted so as to sense any other location that is desired to regulate.

The PLM dual flow, dual mixing system, has other features and advantages. A solenoid valve, labeled SXV 54 is in the path from the proportional valve 24 to the second mixer 32. The SXV 54 is controlled by the controller 18, so it can be shut off whenever the system is programmed to make a change in the target temperature from one level to a higher level. Shutting off this path at the SXV 54 assures that all hot gases flow to the input of the first mixer 50, and more rapidly increase the temperature of the flow into the thermal load 30. In the input to the SXV 54, a settable impedance, shown symbolically, constituting a controllable orifice 78 is included, in parallel to a comparable settable impedance or controllable orifice 79 in the direct path to the first mixer 50. By the use of these control orifices 78 and 79, the two separate flows of pressurized gas fed into the first mixer 50 and second mixer 32 can be proportioned and balanced as desired. The system also includes, as shown, a heater 117 in the input to the compressor 12, which heater 117 may be activated by the controller 18 to convert a liquid containing mixture returning from the second mixer 32 to the wholly gaseous phase for proper operation of the compressor 12.

Mixing the hot gas from the proportional valve 24 with the cooled expanded flow from the TXV 26 after the thermal load 30 retains the essential benefits of the TDSF system, but offers particular added benefits. These are particularly applicable where substantial pressure drops or differentials in heat transfer coefficients may be encountered or exist within thermal load 30. The mass flow from the proportional valve 24, when combined with the system flow at the second mixing tee 32 and also with the TXV 26 output to the first mixing tee 50, modulates the pressure within the load 30. This variation affects the temperature within the circuit and thereby controls the temperature of the load. With PLM, the temperature level across a thermal load, such as a semiconductor chuck can be contained within tolerances that are more precise than previously expected. Tests of a practical system show a reduction in temperature differential to 3° C. from a prior 10° C. differential.

The media fed into the thermal load 30 is stabilized in temperature throughout its flow path in the heat exchanger therein because of the total pressure of the refrigerant fluid, which pressure is controlled by the proportion of hot gas propagated into the circuit. The pressure of the refrigerant in the suction line to the compressor 12 is influenced by the mass passed into the compressor, which compressor 12 processes a fixed volume per unit of time. Because of these interrelated factors, the thermal load 30 is more tightly temperature controlled than in non-PLM based systems. In the system shown, the flow through the thermal load 30 is generally restricted so as to be completely or almost completely that refrigerant that flows through the thermo-expansion valve 26. By so limiting the flow, the pressure drop undergone by the refrigerant passing through the load is lessened. Also, since the hot gas is mixed at the second mixer 32 with the two-phase output of the TXV 26 after the output has passed through the load 30 there is a greater percentage of liquid in the mix at this point. Thus the heat transfer coefficient is maintained high throughout the thermal load 30. Therefore, adjustments in the two flows can also be made after sensing the thermal load temperature, in order to anticipate temperature differentials.

Figure 5:
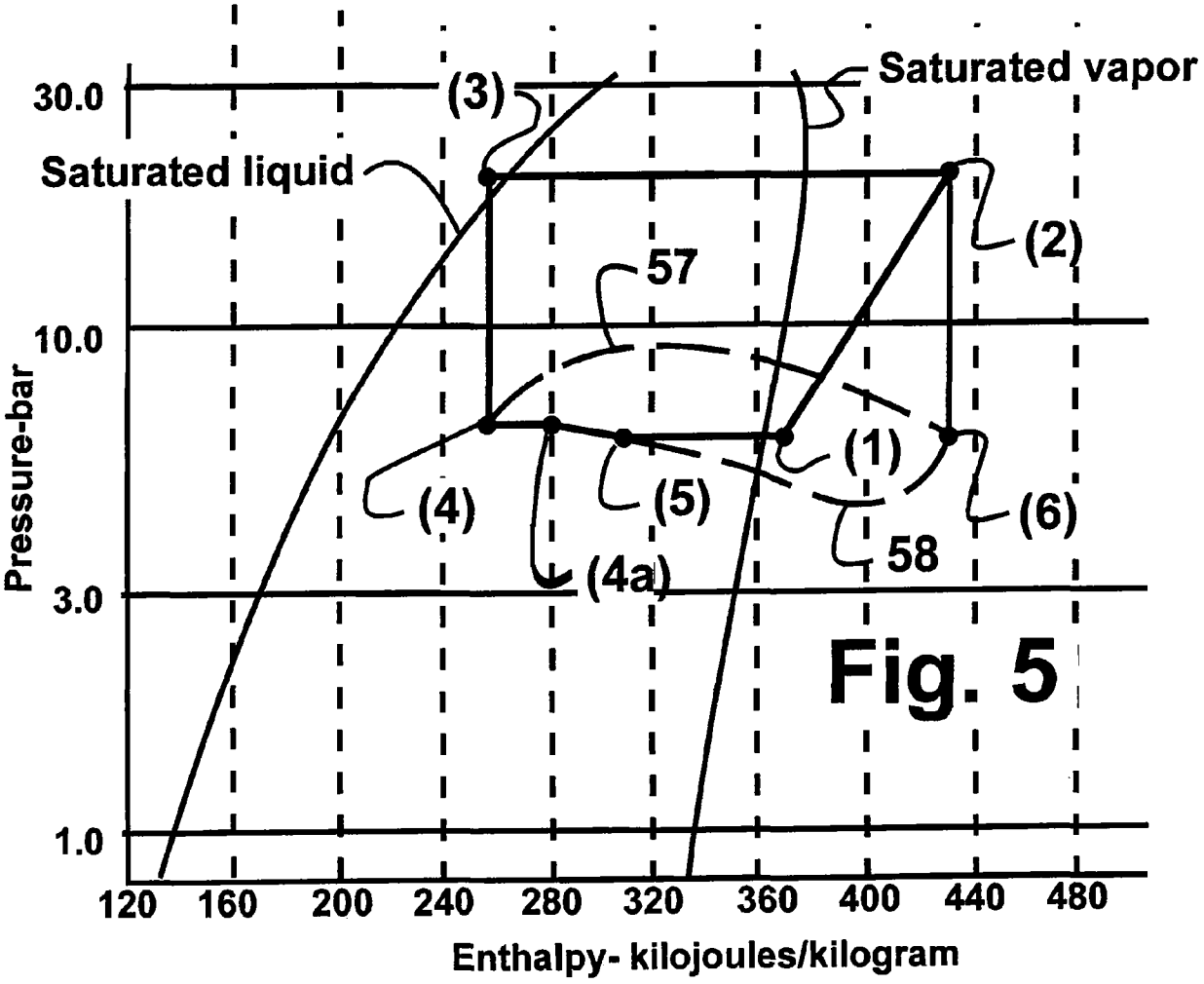
FIG. 5 is a Mollier diagram evidencing thermodynamic changes in states existing in a typical system in accordance with the invention, such as shown in FIG. 1.

Reference should now be made to the Mollier diagram of FIG. 5 which depicts the thermodynamic variations in enthalpy (abscissa) vs. pressure (ordinate) in a complete cycle for the system of FIG. 1. The pressure-enthalpy points in FIG. 5 are identified by numbers in parentheses to correspond to the similarly identified numbers in brackets positioned around the block diagram of FIG. 1. Thus the input at point (1) to the compressor 12 is, as seen in FIG. 5 increased by the compressor in pressure and enthalpy to point (2) before some of it is liquefied in condenser 14 to point (3). After controlled expansion to point (4) in the TXV 26, then consequently mixing some hot gas from the proportional valve 24 at point (6) in the first mixer 50 (see also FIG. 1) results in an increase in enthalpy to point (4*a*). This interchange is illustrated in FIG. 5 by the dotted line 57 between points (6) and (4). Passage of the refrigerant through the thermal load 30 absorbs heat from thermal load 30 and shifts the enthalpy to the point (5). The injection of pressurized hot gas at the input to the second mixing tee 32 of FIG. 1, as also shown at point (6), and depicted by dotted line 58 on FIG. 5. This input adjusts the heat and enthalpy from point (5) to point (1). The addition of hot gas at the mixing tees 50 and 32 also adjusts the pressure of the throughput flow, thus further and more precisely adjusting the temperature of the refrigerant at the thermal load 30. Consequently, the controller 18 may set the proportional valve 24 to vary the hot gas mass flow, and responsively, the cooled expanded flow from the TXV 26, to create pressure and enthalpy parameters at the operative levels needed to achieve a target temperature at the thermal load 30. In this system, the restriction of the direct flow through the load 30 reduces the pressure drop through the load 30 to a minimum. Also, the heat transfer coefficient within the load 30 is maintained at a maximum. Accordingly, the system provides superior results in achieving and maintaining target temperature.

This conclusion is exemplified by factual results achieved in the use of the PLM concept in controlling the temperature of an electrostatic chuck used in semiconductor processing. In prior systems, temperature control units have used a liquid mix of thermal exchange fluid, and provided temperature differentials of the fluid through the chuck typically averaging 10° C. (±5° C.). Using post load mixing, however, the temperature differential through the entire area of the chuck was reduced to no more than about ±3° C.

Figure 2:
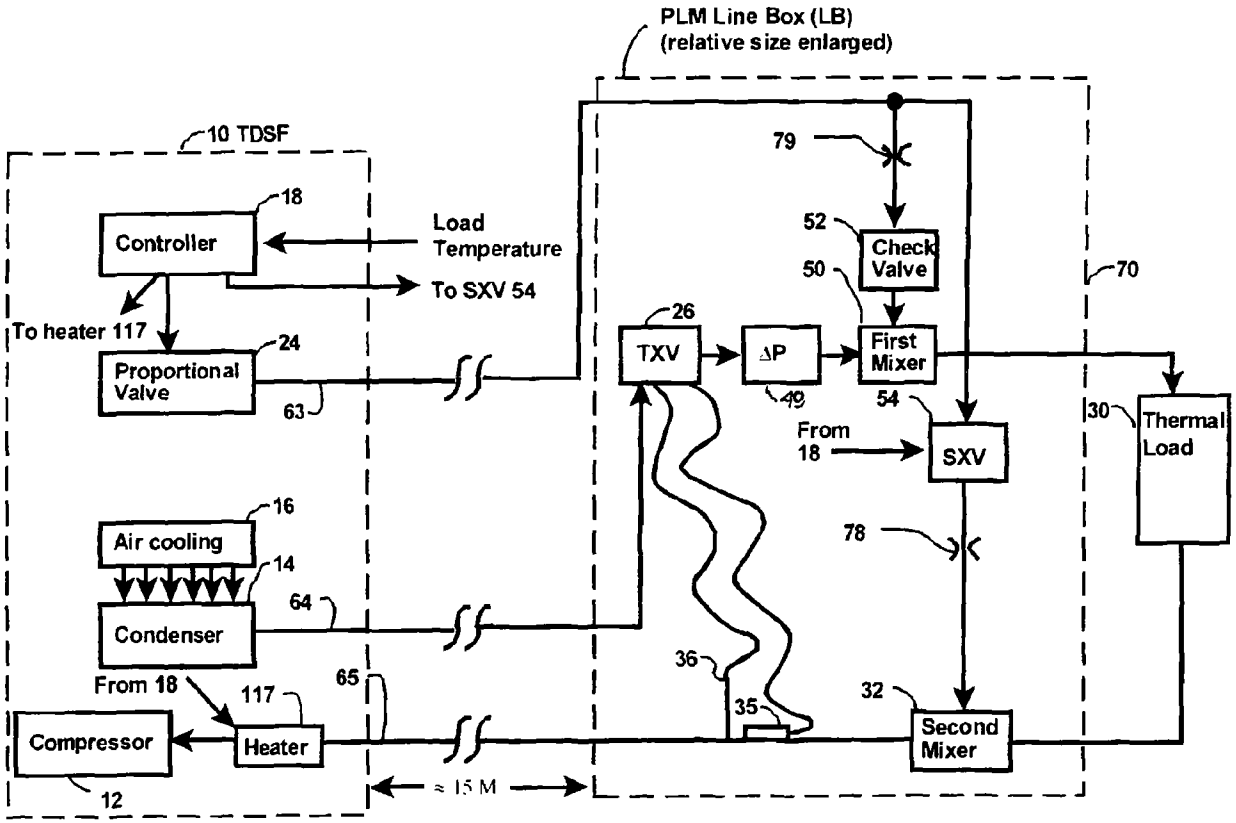
FIG. 2 is a block diagram representation of a PLM system incorporating a compact remote control box.
Figure 3:
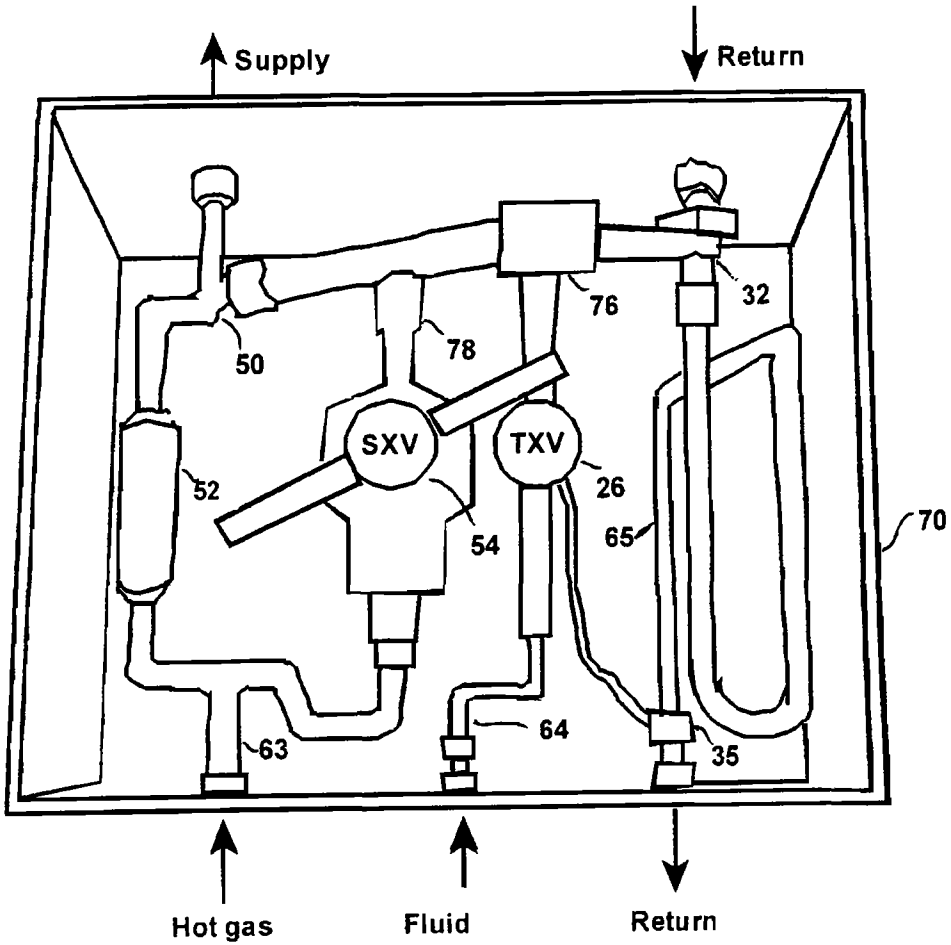
FIG. 3 is a perspective view, in plan, of an example of the elements interior to a remote control box

FIGS. 2 and 3 disclose an alternative which resolves problems of unwanted liquefaction in transporting a two-phase medium in a long line system employing the TDSF concept. For completeness, the system diagram of FIG. 2 partially repeats the principal elements of FIG. 1, placing the principal subsystems that provide phase conversion or energy consumption in a single block labeled "TDSF system" 10. From this system, a hot gas line 63 controlled by a proportional valve 24, a cooled liquid flow line 64 from the condenser 14 and a return line 65 to the compressor 12 are all coupled to a remote control box here termed a PLM Line Box (or LB) 70. The energy converting units in the TDSF system 10 are not attempted to be depicted to scale, in the interest of clarity and understanding, since the Line Box 70 is exaggerated, as the subsystems of interest. The system of FIG. 2 solves a problem which may arise because of the manipulation, in the TDSF system, of gas and liquid phases of refrigerant, in an advantageous manner for temperature control. Concurrent modulation can introduce undesired liquefaction as in the transport of the two-phase medium along a long path. The system of FIG. 2 addresses this problem effectively, and details of a specific implementation further confirming this result are shown in FIG. 3, to which reference should also be made.

In order efficiently to utilize the thermal and fluid pressure energy in the lines 63 and 64 in propagating fluids to and from the physically well separated TDSF system 10, the operative elements for mixing and control are principally located relatively remotely in what is here called a "PLM Line Box" 70, as shown in both FIGS. 2 and 3. In this practical example, the Line Box 70 is very small in volume by comparison to the energy generating subsystems. The example shown in FIG. 3 is 12"×12"×6", or 864 $in^3$, and it is typically located within about 1 meter or less from the thermal load 30 input and output points. In the LB 70, the condensate line 64 is directed to a thermo-expansion valve 26 the output of which is applied to a Δp valve 76 for pressure reduction, as is well known in TDSF systems. The thermo-expansion valve (TXV) 26 is externally equalized by pressure transmitted from a point in return line 65 via line 36. Consistent with the system diagram of FIG. 1, at a suitable point in line 65 a sensor bulb 35 is disposed in thermal communication with the return line 65 to sense the temperature of flow returning to the TDSF system 10. The output from the Δp valve 49 is combined with a portion of the high pressure hot gas flow from the line 63 that is transmitted through a check valve 52 to one input of a first mixer 50, which also receives a separate input from the Δp valve 76. The output from the first mixer 50 is, as is disclosed above in relation to FIG. 1, applied to the input of the thermal load 30.

Also consistent with the arrangement of FIG. 1, the output of the thermal load 30 is coupled to one input of a second mixer 32 having a second input ultimately receiving the flow of pressurized hot gas from the line 63. This bypass flow is, consistent with FIG. 1, directed through a solenoid valve, (designated SXV) 54 that is operated by signals from the controller 18. The input to the SXV 54 is applied via the flow control orifice 78, inserted to balance flows between the bypass path and the separate path to the thermal load 30. From the flow balancing or control orifice 78 the flow is directed to the second input of the second mixer 32 that is in circuit with the return line 65 to the compressor 12 input.

The arrangement of elements inside the PLM Remote Box 70 is shown three dimensionally in FIG. 3, with the depicted elements being numbers correspondingly to the elements in FIG. 2. Although the volumetric size, as set forth above, is very compact by comparison to the compressor and condenser units, it is fully functional for the semiconductor chuck installation. The unit can be further compacted as desired.

Incorporating the operative control elements for unification and mixing of the two flows of refrigerant in the very small volume illustrated in FIGS. 2 and 3 resolves the problem of unwanted temperature variations and accumulation of liquid in the return line, all while retaining the benefits of the PLM approach. The PLM flow balance orifices 78 and 79 control the flow proportions both before and after the thermal load 30. Furthermore, the added line in the TDSF system 10 provided by the PLM Remote Box 70 directs the bulk of hot gas around the load so that it can unite with the two-phase liquid after the load 30. Consequently the "quality" of the fluid that is fed to control the thermal load 30 is lowered, while still operating in the PLM mode. In effect, there is an increase in the liquid content in the two-phase mixture that is supplied to the load, which enhances the cooling efficacy of the two-phase liquid. The advantages of employing the PLM mode in conjunction with long line installations, are made evident in an objective way by the comparison of performance characteristics in FIG. 6, to which reference is now made. This comparison is between a conventional chiller, such as an Advanced Thermal Sciences, MP40C, and a "direct chiller" of the TDSF type that incorporates the present post-load mixing Long Line improvement. In all individual parameters that are significant to throughput and uniformity the chiller disclosure herein confirms the significant improvement in performance over a commercially state-of-the-art unit. Care was taken to ensure test conditions were comparable in all respects.

Figure 4:
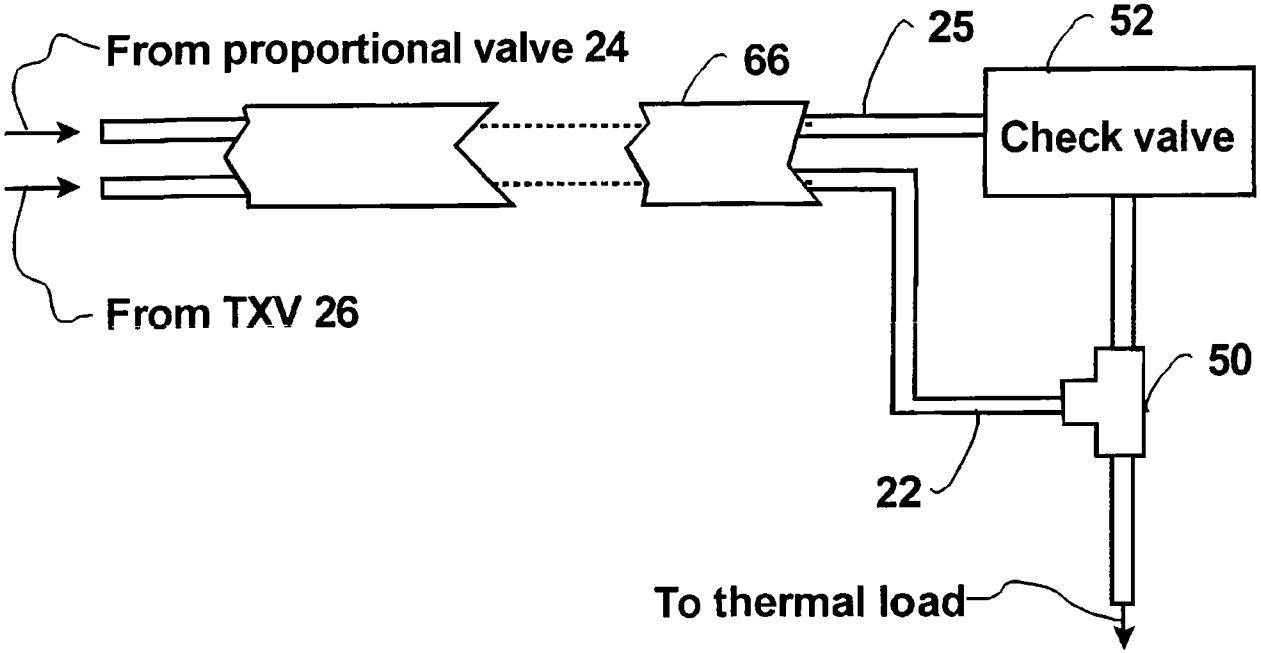
FIG. 4 is a fragmentary view of a portion of an alternate arrangement for transporting different phases of a refrigerant, processed in accordance with the TDSF concept, prior to mixing.

As a qualitatively limited alternative, when substantial line lengths might introduce problems with liquid puddling within transport lines, unstable temperature changes due to puddling can be limited or avoided using the insulation technique depicted in FIG. 4. The supply line 22 for cooled expanded flow and the output line 25 from the proportional valve 24 (both as shown in FIGS. 1 and 2) are insulated from each other within a jacket 66 until they reach the near vicinity of the load 30, as at the mixer 50.

Although there have been described above and illustrated in the drawings various forms and expedients for post load mixing, the invention is not limited thereto but incorporates all features and alternatives within the coverage of the appended claims.

The invention claimed is:

1. In a system which generates, from a medium, divided separate flows of high pressure gaseous phase of the medium, and a differential flow of the medium in liquid phase and the system requires thermal control of a thermal load at an operative site that is physically displaced from the location at which separate gaseous and liquid flows are generated and divided, a temperature control unit for disposition at the operative site in proximity to the thermal load comprising:

a thermo-expansion device receiving the liquid phase of the medium and providing a cooled expanded flow of the gaseous phase of the medium proximate the thermal load, the cooled expanded flow determined by a differential temperature between a superheated gas and a temperature of an output fluid from a second mixer;

a solenoid valve positioned between a proportional valve and the second mixer, the solenoid valve controlled to be shut off whenever the system is programmed to make a change in a target temperature;

a first mixer receiving the high pressure gaseous phase of the medium at one input and providing an output to the thermal load, the first mixer having a second input receiving a pressurized gaseous phase of the medium; and the second mixer having two inputs and receiving a controlled fraction of the high pressure gaseous phase of the medium at one input from the solenoid valve and the output from the load at a second input, and providing a return output to the system.

2. The temperature control unit of claim 1, wherein a path for the high pressure gas phase of the medium to the first mixer includes a flow balancing orifice and a check valve in series, and wherein a high pressure gaseous phase of the medium flow path to the second mixer includes a shutoff valve and a flow balancing orifice in series, and wherein the temperature control unit includes a structure encompassing the thermo-expansion device, the first and second mixers, the flow balancing orifices, check valve and shutoff valve within its volume.

3. A method for a temperature control system using a two-phase refrigerant for direct heat transfer with a thermal load, wherein the refrigerant is divided into flows of pressurized hot gas and cooled expanded refrigerant after condensation, and wherein said divided refrigerant flows are at least partially mixed in both pre-load and post-load positions relative to said thermal load, the method comprising the steps of:

at least partially expanding said condensed refrigerant to lower the temperature thereof in close juxtaposition to the thermal load;

modulating a condensed phase of a refrigerant in a first mixer with an initial portion of a high pressure gas phase of the refrigerant to establish a media for controlling a temperature of a load;

passing the media into heat exchange relation with said thermal load;

introducing a remaining portion of high pressure gas phase to the media at a second point located after passing the media into heat exchanging relation with the thermal load, where percentages of the initial portion of high pressure gas phase and remaining portion of high pressure gas phase are adjusted in response to a temperature at the thermal load and a pressure determination after the remaining portion of high pressure gas phase is introduced to the media;

and actuating a solenoid valve to route all of the high pressure gas phase to the media at the first mixer to rapidly increase a temperature at the load.

* * * * *